United States Patent [19]

Madnick et al.

[11] Patent Number: 4,495,659

[45] Date of Patent: Jan. 29, 1985

[54] COLD-WEATHER MUFF

[75] Inventors: Herman Madnick; Ralph F. Goldman, both of Framingham, Mass.

[73] Assignee: Multi-Tech Corporation, Natick, Mass.

[21] Appl. No.: 547,754

[22] Filed: Nov. 1, 1983

[51] Int. Cl.[3] ..... A41D 5/00

[52] U.S. Cl. ..... 2/66; 219/212

[58] Field of Search ..... 2/66; 219/212

[56] References Cited

U.S. PATENT DOCUMENTS

| | | | |
|---|---|---|---|
| 95,240 | 9/1869 | Levy | 2/66 |
| 405,097 | 6/1889 | Kaehler | 2/66 |
| 2,727,241 | 12/1955 | Smith | 2/66 |
| 3,793,643 | 2/1974 | Kinoshita | 2/66 |
| 4,221,954 | 9/1980 | Cohen | 2/66 X |
| 4,408,555 | 10/1983 | Brock | 2/66 |

*Primary Examiner*—Doris L. Troutman

*Attorney, Agent, or Firm*—Weingarten, Schurgin, Gagnebin & Hayes

[57] ABSTRACT

A cold-weather muff includes an elongated generally cylindrically shaped insulative member having open ends, a water resistant and wind-proof lining surrounding the insulative member, and an inner liner disposed within the insulative member having longitudinally opposed left and right hand receiving pockets and a chemical heating element receiving chamber intermediate the left and right hand receiving pockets. Resilient collars are provided on the open ends that are individually cooperative with respective ones of the left and right hand receiving pockets to minimize convective heat loss by preventing wind from passing through the muff. An emblem may be fastened to the outer lining displaying any desired indicia. A flap on the outer lining provides a resealable closure for the chemical heating element receiving chamber. The cold-weather muff is particularly advantageous for spectator sports, and may readily be incorporated in any suitable body garment such as a hooded sweatshirt.

14 Claims, 15 Drawing Figures

FIG. 5D
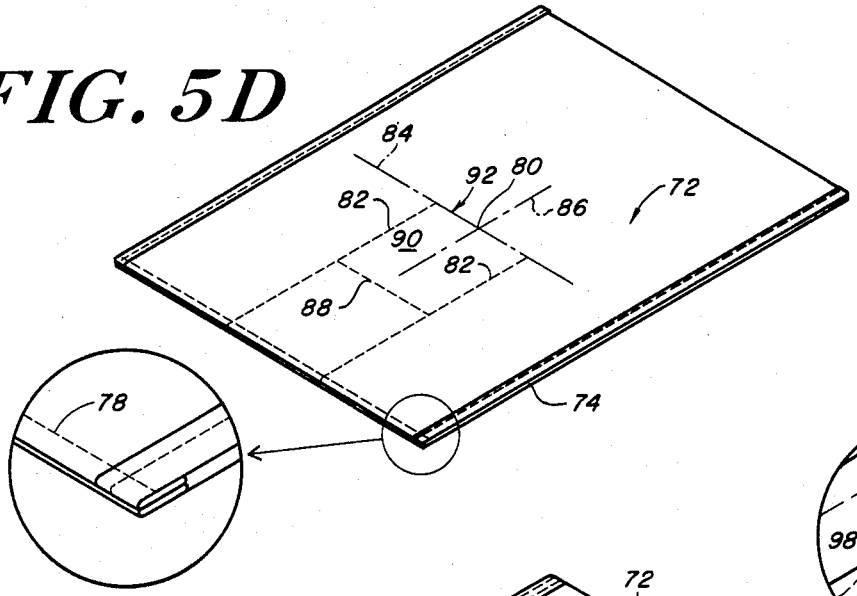
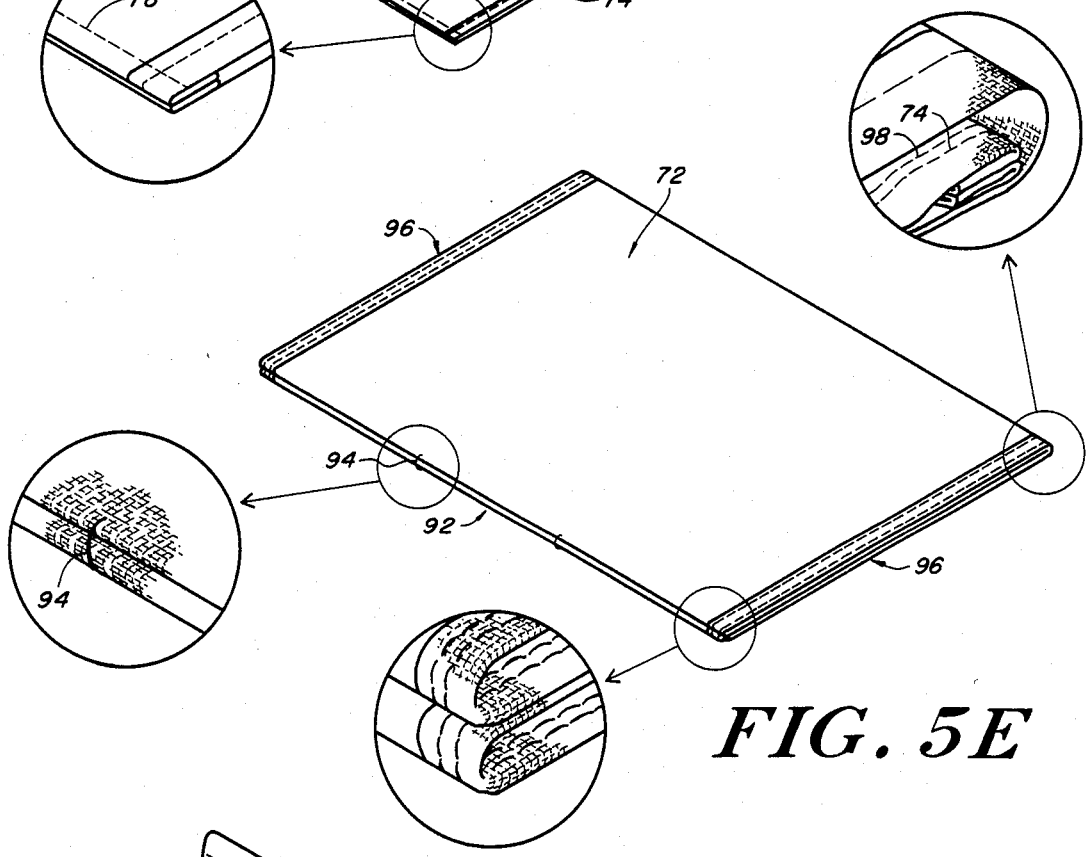
FIG. 5E
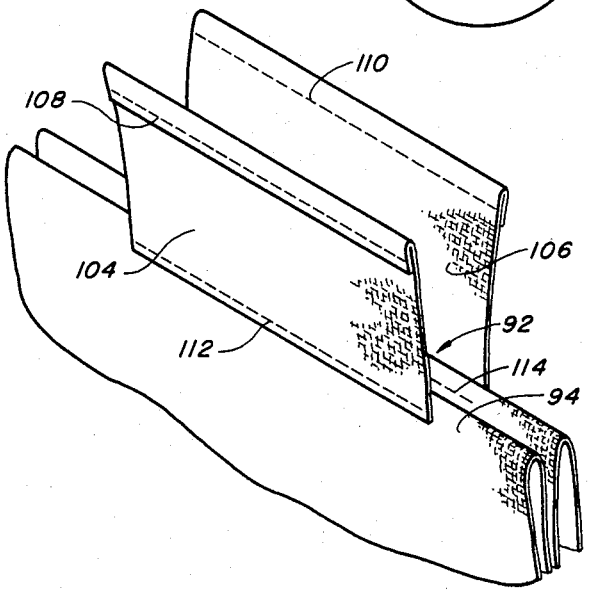
FIG. 5F

COLD-WEATHER MUFF

FIELD OF THE INVENTION

This invention is directed to the field of apparel, and more particularly, to a novel cold-weather muff.

BACKGROUND OF THE INVENTION

The construction of hand coverings have employed a variety of techniques to maintain the hands at a selected warm temperature above ambient cold temperature to promote the cold weather comfort of a wearer. Insulative layers of low thermal transmissivity material are commonly incorporated into gloves, muffs, and other hand coverings to passively prevent head loss therefrom, and resistance heaters having various configurations are commonly incorporated into various hand coverings to actively supply heat to the hands. Such hand coverings are called upon to keep the hands of non-moving persons such as sports spectators warm; to minimize heat loss from the hands due to wind-induced convective heat transport; to be light in weight and easily transportable; to be inexpensive to manufacture; to provide a uniform source of heat that is reliable, inexpensive, safe, and easily maintained; and to present an aesthestically pleasing appearance. The heretofore known hand coverings are deficient in one or more of these aspects.

SUMMARY OF THE INVENTION

The novel cold-weather muff of the present invention includes an elongated generally cylindrically shaped insulative member having spaced opened ends. A left hand receiving pocket having an open end and a sealed end is positioned inside the insulative member with its open end in communication with one opened end of the insulative member and with its sealed end terminating within the insulative member. A longitudinallly opposing right hand receiving pocket having an open end and a sealed end is positioned inside the insulative member with its open end in communication with the other opened end of the insulative member and with its sealed end terminating within the insulative member. A chemical heating element receiving chamber is provided between the left and right hand receiving pockets that opens through the wall of the insulative member at a point intermediate its ends. A chemical heating element is inserted into the chamber for heating the inside of the insulative member. Preferably, the left and right hand receiving pockets, and the chemical heating element receiving chamber, are formed as a liner slidably inserted in the insulative member. The liner preferably includes a single length of fabric selectively folded and stitched to form the left and right receiving longitudinally opposing pockets as well as the chemical heating element receiving chamber. Resilient collars are provided circumferentially around each of the opened ends of the insulative member that each conform to the forearm of a wearer and provide a wind-seal therearound. The resilient collars and the longitudinally opposing left and right hand receiving pockets are cooperative to prevent the passage of wind through the muff thereby minimizing convective and conductive heat loss. The chemical heating element is readily inserted and removed from the chamber and provides a uniform source of low-cost, high-grade, and completely safe heat. A water-resistant and wind-proof shell of an aesthetically pleasing material is affixed peripherally around the outside of the insulative member that is capable of accepting any suitable indicia. A resealable closure is provided on the shell adjacent the openings of the chemical heating element receiving chamber. The muff may readily be incorporated into a garment.

BRIEF DESCRIPTION OF THE DRAWINGS

These and other features of the present invention will become apparent as the invention becomes better understood by referring to the following exemplary and non-limiting detailed description of the preferred embodiment, and to the drawings, wherein:

FIGS. 5A–5F are partially enlarged perspective views illustrating the inner lining of the cold-weather muff according to the present invention;

DETAILED DESCRIPTION OF THE PREFERRED EMBODIMENT

Figure 1:
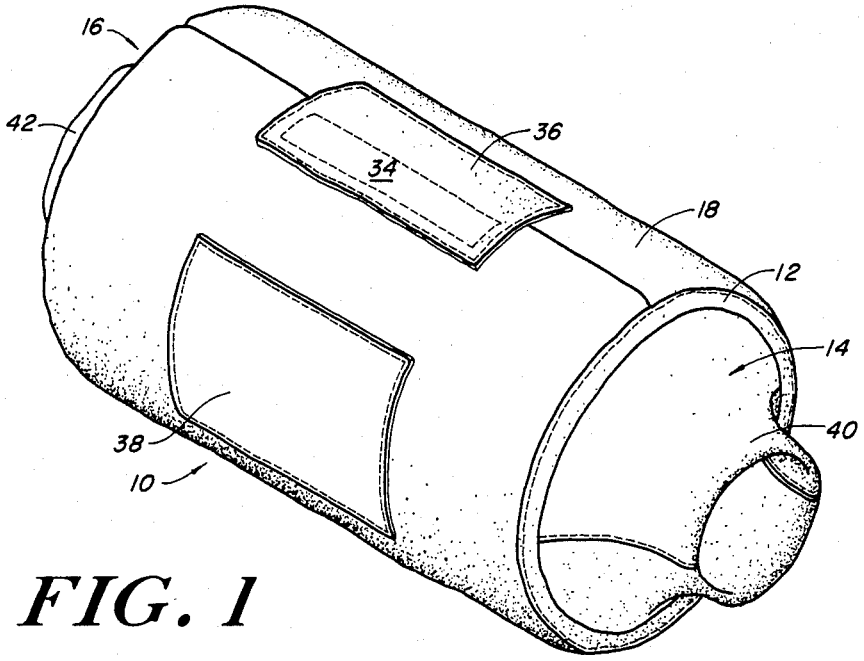
FIG. 1 is an isometric view illustrating the novel cold-weather muff according to the present invention.
Figure 2:
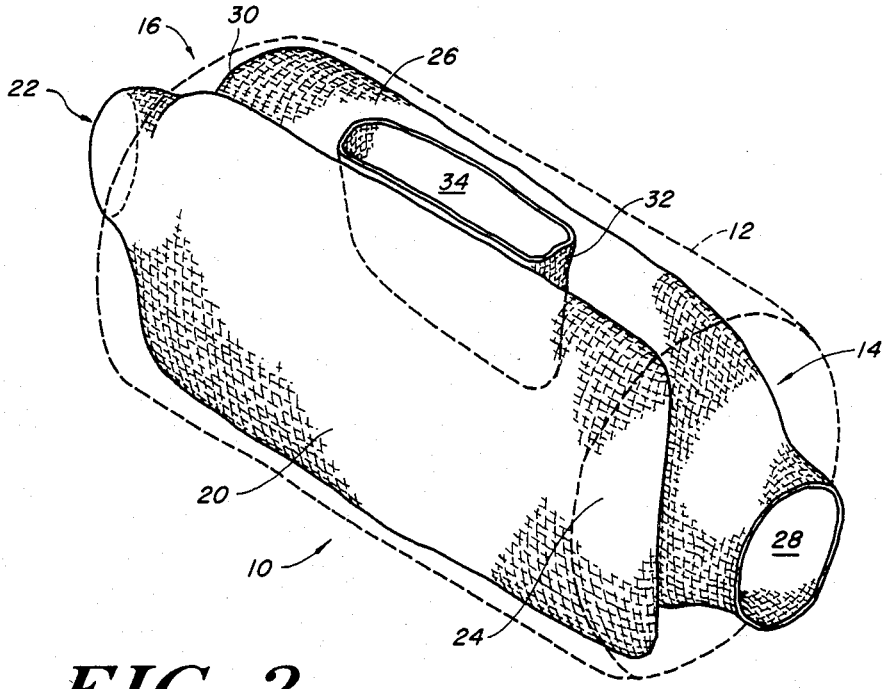
FIG. 2 is a partially schematic pictorial view illustrating the cold-weather muff of the present invention.

Referring now to FIGS. 1 and 2, generally designated at 10 is a novel cold-weather muff according to the present invention. The muff 10 includes an elongated, generally cylindrical insulative member 12 having opened ends 14, 16. An outer, elongated water-resistant and wind-proof generally cylindrical outer shell 18 is provided surrounding the insulative member 12. A left hand receiving pocket 20 is provided inside the member 12 having an open end 22 in communication with the end 16 of the member 12 and a sealed end 24 within the member 12, and a longitudinally opposing right hand receiving pocket 26 is provided inside the member 12 having an open end 28 in communication with the end 14 and a sealed end 30 within the member 12. Walls 32 are provided within the member 12 defining a chemical heating element receiving chamber 34 intermediate the pockets 20, 26 that opens through the member 12 at a point intermediate its opened ends. Although the pockets 20, 26, and the chamber 34 can be fabricated in any suitable manner, as appears below, they are preferably formed in a liner fabricated from a selectively folded and stitched fabric. A resealable closure 36 is affixed to the shell 18 in position to cover the opening of the chamber 34, and an emblem 38 bearing any suitable indicia, such as "NFL", not illustrated, is affixed to the shell 18. Resilient collars 40, 42 are stitched to respective opened ends 14, 16. A chemical heating element, not shown, is disposed in the chamber 34.

Figure 3A:
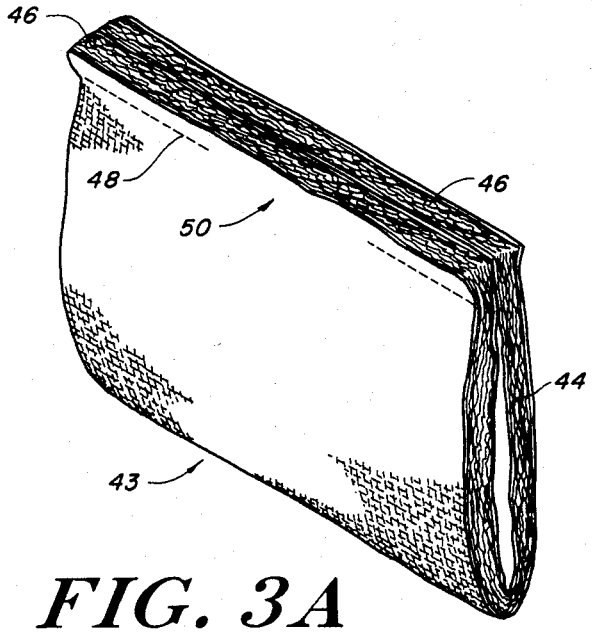
FIGS. 3A and 3B are isometric views illustrating the insulative member of the cold-weather muff according to the present invention.
Figure 3B:
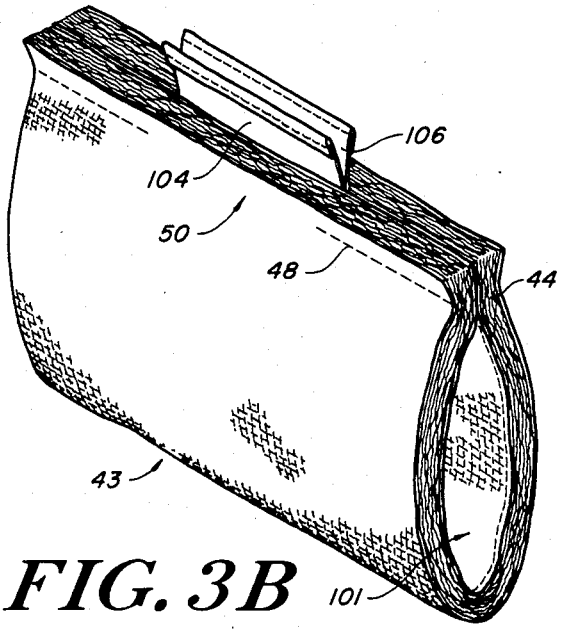

Referring now to FIG. 3, generally designated at 43 is the insulating member of the cold-weather muff according to the present invention. The member 43 preferably includes a cut-length of any suitable flexible insulating material 44 that is closed on itself to form an elongated annulus. Preferably, the sides 46 of the insulating material 44 are stitched together as at 48, except for a central portion 50 as shown in FIGS. 3A and 3B. The central portion 50 defines an opening to be described centrally through the stitched ends of the material 44. The insulating material 44 prevents conductive and convective heat loss radially through the sides of the member 43.

Figure 4A:
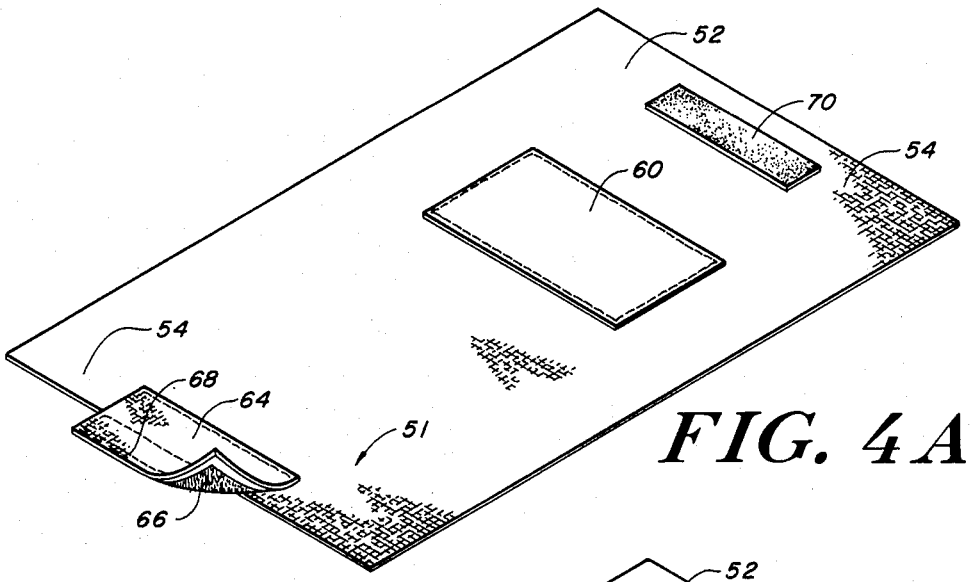
FIGS. 4A and 4B are perspective views illustrating the outer shell of the cold-weather muff according to the present invention.
Figure 4B:
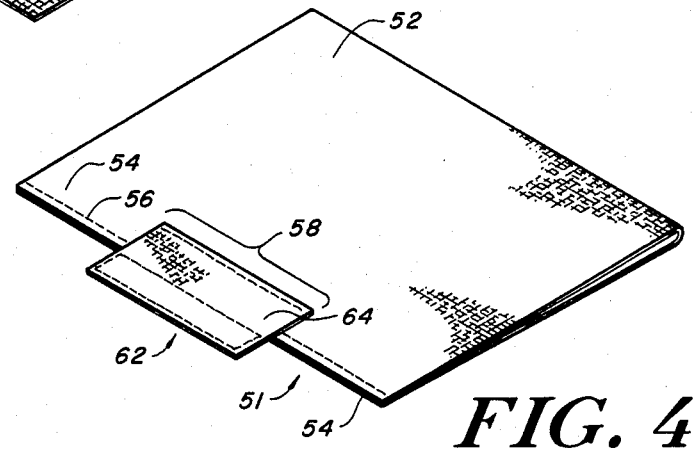

Referring now to FIG. 4, generally designated at 51 is the outer shell of the cold-weather muff according to the present invention. The outer shell 51 preferably includes a cut-length of any suitable aesthetically pleasing wind-proof and water-resistant fabric 52 (FIG. 4A) that is closed on itself to form an elongated annulus as shown in FIG. 4B. The inside dimention of the annulus is selected to be slightly larger than the outside dimention of the insulative member 43 and is slidably mounted thereover and affixed thereto in a manner to be described. The sides 54 of the fabric preferably are stitched together as at 56, (FIG. 4B) except for a central portion designated by a bracket 58 that defines an opening that cooperates with the opening defined by the central portion 50 (FIG. 3A) of the insulative member 43 (FIG. 3) in a manner to be described.

An emblem 60 bearing any selected indicia, not shown, may be fastened in any suitable manner to the fabric 52 of the outer shell as shown in FIG. 4A. When an emblem is desired, it preferably is stitched to the fabric 52 of the outer shell prior to closing the fabric on itself to form the elongated annulus.

A resealable closure generally designated 62 (FIG. 4B) having a separable fastening device is fastened to the fabric 52 by any suitable means proximate the opening 58. The closure 62 preferably includes an elongated flap 64 stitched to one side of the fabric 52 that extends beyond the edge thereof, and a strip 66 of VELCRO stitched as at 68 (FIG. 4A) to the extending portion of the flap 64. A strip of complimentary VELCRO 70 (FIG. 4A) is preferably stitched to the other side of the fabric 52. As appears below, the flap pivots between an open and a closed condition that grants and seals access to the chemical heating device receiving chamber 34 (FIG. 1). The flap 64 and the VELCRO strip 70 are stitched to the fabric 52 of the outer shell at a time prior to stitching the sides thereof together.

The pockets 20, 26 (FIG. 2) and the chamber 34 (FIG. 2) are preferably formed as a liner from a cut length of selectively folded and stitched fabric.

Figure 5A:
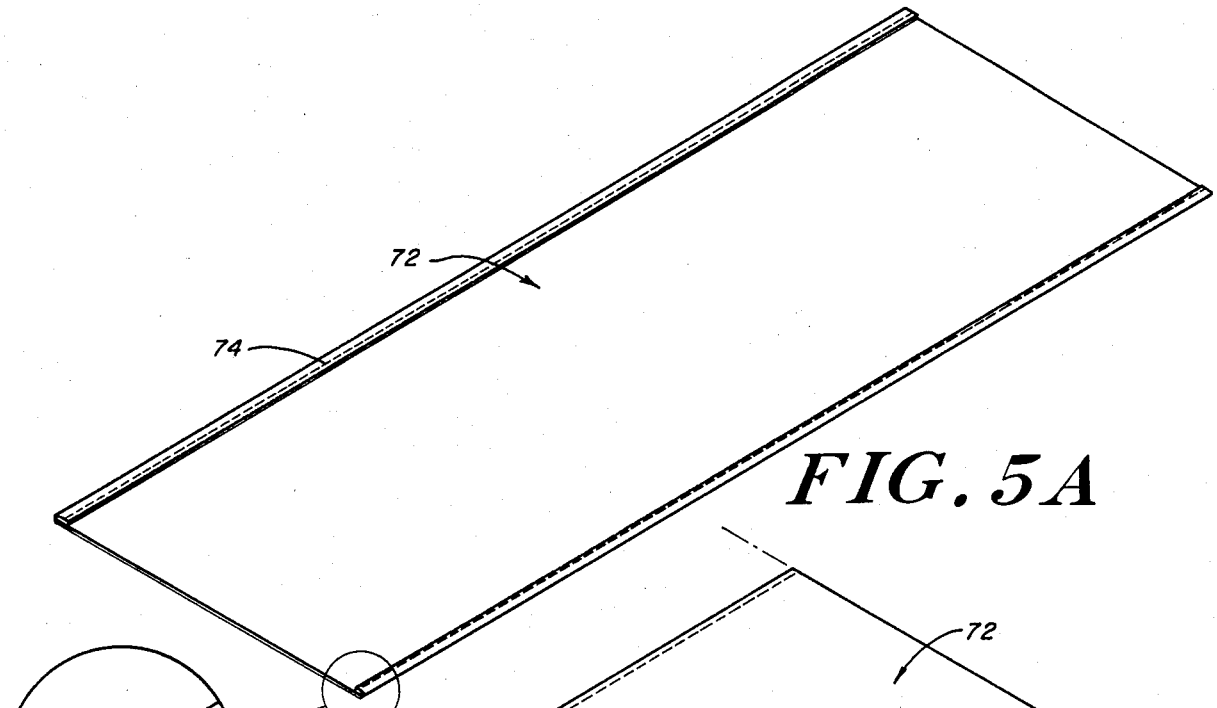
Figure 5B:
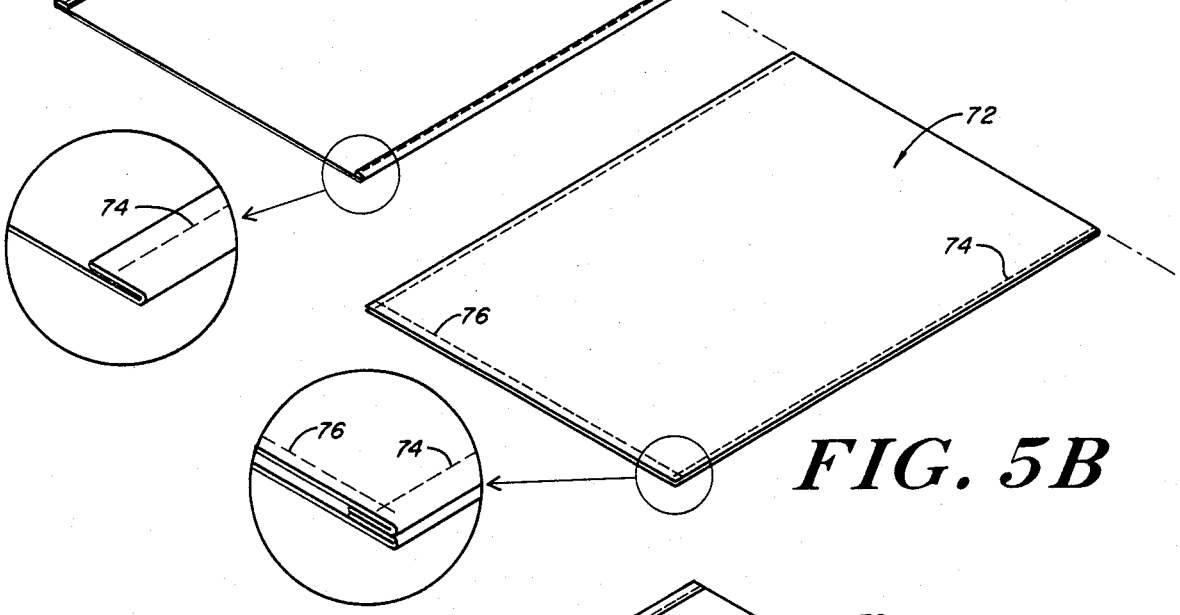
Figure 5C:
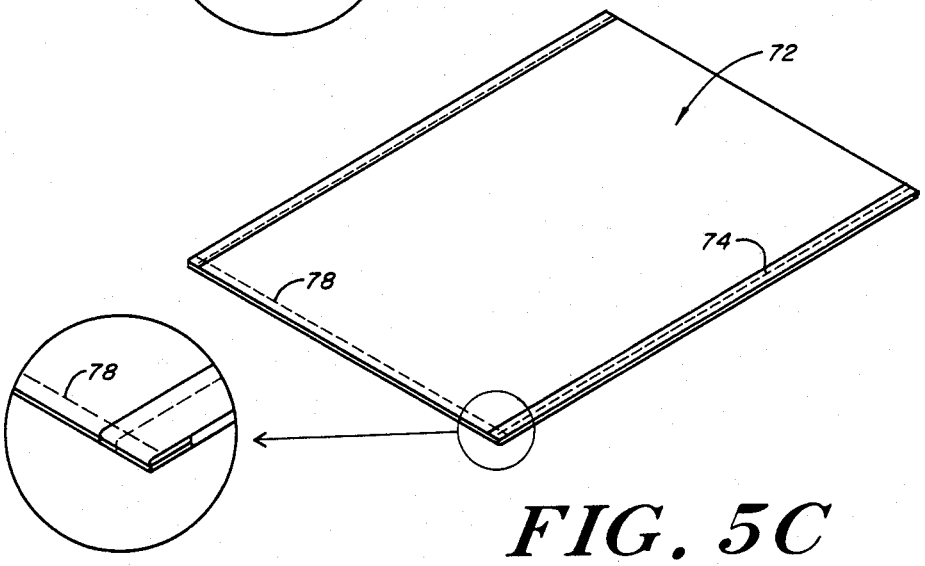

Referring now to FIG. 5, which illustrates the steps in fabricating the liner, generally shown at 72 in FIG. 5A is a selected length of fabric that is stitched along its ends as at 74 to prevent ravelling. The fabric 72 is folded about its midpoint, and stitched along the aligned edges thereof as shown at 76 in FIG. 5B. The fabric is returned and top stitched along the aligned edges as shown at 78 to provide a secure, next seam therebetween, as illustrated in FIG. 5C.

As shown in FIG. 5D, the center 80 of the folded fabric 72 is identified, and stitching 82 is provided from the left hand edge to the verticle center line 84 symetrically about both sides of the horizontal center line 86. Stitching 88 is provided between the spaced rows of stitching 82 intermediate the stitched aligned ends and the verticle center line defining a chamber 90 dimentioned to receive a chemical heating element that opens along its unstitched side 92.

Figure 6:
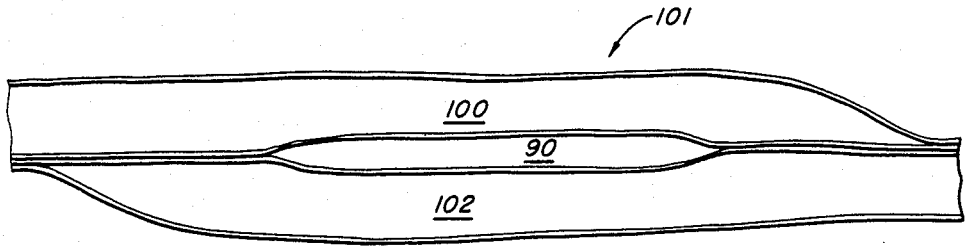
FIG. 6 is a sectional view illustrating the left and right hand receiving pockets and the intermediate chemical heating element receiving chamber of the liner of the cold-weather muff according to the present invention.

As shown in FIG. 5E, the folded and sewn fabric 72 is turned inside out. The ends of the opening 92 are stitched as at 94 to prevent the tearing of the side walls 82 (FIG. 5D) of the chamber 90. Along each of the ends 96 of the inside out sewn and folded fabric 72, three of the four layers of fabric are stitched together at as 98 with the layer not stitched on one end stitched on its other end defining thereby a liner 101 having a left and right hand receiving pocket 100, 102 and the intermediate chamber 90 as illustrated in FIG. 6. Tabs 104, 106 having turned over and stitched ends 108, 110 are stitched to the fabric adjacent the opening 92 as at 112, 114 in FIG. 5F.

Returning now briefly to FIG. 3B, the liner 101 is slidably inserted in the insulative member 43, with the tabs 104, 106 being inserted through the central opening 50 provided therefor, and with ends of the liner 101 in alignment with the ends of the member 43.

Figure 7:
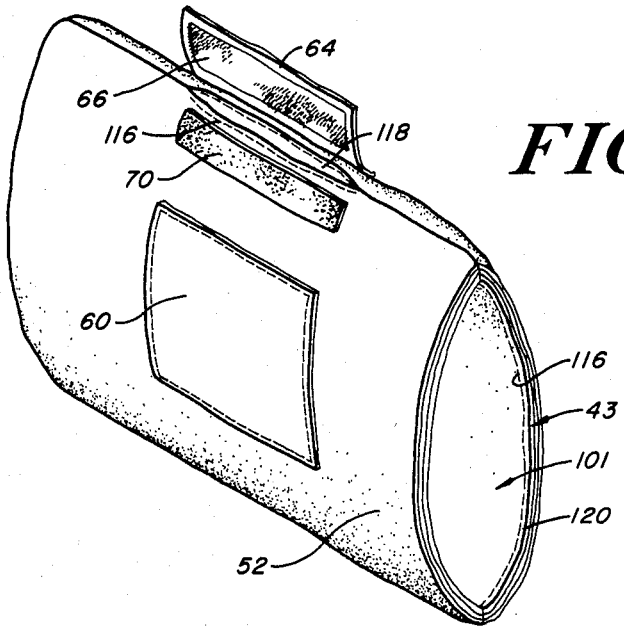
FIG. 7 is an isometric view illustrating the cold-weather muff according to the present invention without the resilient collars and with the flap in an open condition.

As shown in FIG. 7, the insulative member 43 (FIG. 3B) having the liner 101 slidably received therein (FIG. 3B) is slidably inserted into the outer shell 52 with the tabs 104, 106 (FIG. 3B) being received through the opening 58 (FIG. 4B) provided therefor in the outer shell. The tabs 104, 106 are turned in and stitched as at 116, 118 to the outer shell, and the liner 101 is stitched at respective ends to the opened ends of the outer shell and insulative member as at 120. The resilient collars 40, 42 (FIG. 1) are then stitched to respective opened ends.

The flap 64 pivots between an open condition (FIG. 7) to a closed condition (FIG. 1). In the open condition, any suitable chemical heating element such as a "Handi-Heat" device of the Hakujen, Ltd. Company of Tokoyo, or the "Mini-Mini" device of the Unique-World of Tokoyo is slidably inserted in the chemical heating element receiving chamber for heating the hands. In the closed condition, the complementary VELCRO 66, 70 (FIG. 7) removably retains the flap 64 access the opening of the chamber providing an abutment that retains the chemical heating device in the chamber as shown in FIG. 1.

Figure 8:
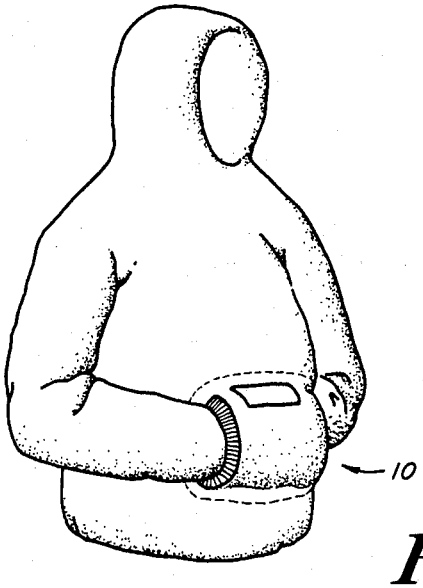
FIG. 8 is a perspective view illustrating the cold-weather muff incorporated in a body garment according to the present invention.

The novel cold-weather muff of the present invention may readily be affixed to any suitable garment, such as a hooded sweatshirt, as shown in FIG. 8.

It will be appreciated that many modifications of the present invention are possible within the scope of the appended claims.

What is claimed is:

1. A cold-weather muff, comprising:

first means defining a generally cylindrical insulative tube having a longitudinally extending channel and opened ends;

second means disposed in said longitudinally extending channel for providing a left hand receiving pocket having an open end in communication with one of said opened ends of said insulative tube and having a sealed end terminating inside said longitudinally extending channel;

third means disposed in said longitudinally extending channel for providing a right hand receiving pocket having an open end in communication with the other one of said opened ends of said insulative tube and having a sealed end terminating inside said longitudinally extending channel; and fourth means disposed in said longitudinally extending channel for providing a chamber intermediate said left hand receiving and right hand receiving pockets dimensioned to accept a chemical heating element.

2. The invention of claim 1, further including first and second resilient collars fastened to respective opened ends of said insulative tube.

3. The invention of claim 1, further including an outer lining surrounding said insulative tube.

4. The invention of claim 3, wherein said outer lining includes a wind-proof and water-resistant fabric.

5. The invention of claim 4, further including an emblem affixed to said outer lining.

6. The invention of claim 3 wherein said chemical heating element receiving chamber has an opening through the generally cylindrical insulative tube, and further including a flap fastened to said outer lining adjacent to the opening of said chemical heating element receiving chamber that is pivotal between an open position allowing access to said chamber and a closed position that seals the opening of said chamber.

7. A cold-weather muff, comprising:

an insulative tube having opened ends;

a water-resistant and wind-proof outer lining surrounding said insulative tube;

a liner slidably received in said insulative tube having a longitudinally extending first pocket in communication with one of said opened ends, an opposing longitudinally extending second pocket in communication with the other of said opened ends, and a chamber intermediate said first and second pockets that is dimensioned to slidably accept a chemical heating element and having an opening through said insulative tube at a point intermediate its ends; and a flap mounted to said outer lining and pivotal between an open position allowing access to said chamber and a closed position for sealing the opening of the chamber.

8. The invention of claim 7, further including first and second resilient collars fastened to corresponding opened ends of said insulative tube.

9. The invention of claim 8, further including an emblem fastened to said outer lining.

10. The invention of claim 7, wherein said liner is fabricated according to the following steps:

folding a length of fabric to bring its ends in alignment;

fastening the aligned ends together;

identifying the horizontal and vertical center lines of the folded fabric;

fastening the fabric together along spaced lines symmetrically disposed about the horizontal center line and extending from the vertical center line to the fastened and aligned ends;

fastening the fabric together along a vertical line defined between the spaced lines in a direction parallel to the vertical center line of the folded fabric to form said chemical element receiving chamber;

turning the folded and fastened fabric inside out; and selectively fastening the open ends to define said left hand receiving and right hand receiving pockets.

11. The invention of claim 10, wherein said fastening steps are accomplished by stitching.

12. A cold-weather muff, comprising:

an insulative tube having spaced opened ends;

an outer lining of a wind-proof and water-resistant material slidably mounted over said insulative tube;

means disposed in the inside of said insulative tube for providing longitudinally opposing left and right hand receiving pockets each having an open end in communication with a corresponding one of said opened ends of said insulative tube; and first and second resilient collars fastened to respective opened ends.

13. The invention of claim 12, further including means for providing a chemical heating element chamber inside said insulative tube.

14. The invention of claim 13, wherein said chamber has a mouth that opens through the insulative tube and outer liner, and further including a resealable closure fastened to the outer lining proximate said mouth.

* * * * *

UNITED STATES PATENT AND TRADEMARK OFFICE

CERTIFICATE OF CORRECTION

PATENT NO. : 4,495,659 (Page 1 of 2)

DATED : January 29, 1985

INVENTOR(S) : Herman Madnick; Ralph F. Goldman

It is certified that error appears in the above—identified patent and that said Letters Patent is hereby corrected as shown below:

| | | |
|---|---|---|
| Column 1, | line 15 | "head loss" should read --heat loss-- |
| | line 38 | "longitudinallly" should read longitudinally-- |
| Column 3, | line 22 | "dimention" should read --dimension-- |
| | lines 23-24 | "dimen- tion" should read --dimen- sion-- |
| | line 45 | "complimentary" should read --complementary-- |
| | line 67 | "verticle" should read --vertical-- |
| | lines 67-68 | "symetri- cally" should read --symmetri- cally-- |
| Column 4, | line 3 | "verticle" should read --vertical-- |
| | lines 37-38 | "To- koyo" should read --To- kyo-- |
| | line 38 | "Unique-World" should read --Uni-World Corp.-- |

UNITED STATES PATENT AND TRADEMARK OFFICE

CERTIFICATE OF CORRECTION

PATENT NO. : 4,495,659 (Page 2 of 2)

DATED : January 29, 1985

INVENTOR(S) : Herman Madnick; Ralph F. Goldman

It is certified that error appears in the above-identified patent and that said Letters Patent is hereby corrected as shown below:

Column 4, line 39 "Tokoyo is" should read --Tokyo, Japan, is-- lines 42-43 "removably retains the flap 64 access the opening of the chamber" should read --removably retains the flap 64 across the opening of the chamber--

Signed and Sealed this

*Eighteenth* Day of *March 1986*

[SEAL]

*Attest:*

DONALD J. QUIGG

*Attesting Officer*

*Commissioner of Patents and Trademarks*